United States Patent [19]

King

[11] 4,025,249

[45] May 24, 1977

[54] APPARATUS FOR MAKING METAL POWDER

[75] Inventor: Jerry A. King, Palm Beach Gardens, Fla.

[73] Assignee: United Technologies Corporation, Hartford, Conn.

[22] Filed: Jan. 30, 1976

[21] Appl. No.: 653,693

[52] U.S. Cl. ..... 425/6; 425/7; 425/8; 264/5; 264/8; 222/166; 222/463

[51] Int. Cl.[2] ..... B22D 23/08; B29C 23/00

[58] Field of Search ..... 425/7, 8, 10, 6; 222/166, 463; 264/12, 13, 5, 8

[56] References Cited

UNITED STATES PATENTS

| | | | |
|---|---|---|---|
| 2,040,157 | 5/1936 | Story et al. | 222/166 |
| 2,439,772 | 4/1948 | Gow | 425/8 X |
| 2,439,776 | 4/1948 | Klein et al. | 425/8 |
| 3,119,530 | 1/1964 | Swanson | 222/166 |
| 3,695,795 | 10/1972 | Jossick | 264/12 X |
| 3,720,737 | 3/1973 | Klaphook et al. | 264/13 X |
| 3,785,633 | 1/1974 | Karlsson | 425/7 |

*Primary Examiner*—Robert L. Spicer, Jr.
*Attorney, Agent, or Firm*—Jack N. McCarthy

[57] ABSTRACT

An improved apparatus is set forth wherein powder is produced by melting metal in a crucible where it is then poured into a tundish which directs the molten metal onto a spinning disc means. A nozzle plate has a central opening through which the metal is directed from the tundish to the disc means. An efficient annular nozzle means directs a cooling fluid around the disc means. The crucible has means for tilting it which keeps the molten metal entering the tundish properly as the metal is poured therefrom.

4 Claims, 6 Drawing Figures

APPARATUS FOR MAKING METAL POWDER

CROSS-REFERENCE TO RELATED APPLICATION

Application Ser. No. 654,247 to Paul R. Holiday and Robert J. Patterson filed herewith for Method and Apparatus for Producing Metal Powder discloses a similar arrangement.

BACKGROUND OF THE INVENTION

This invention relates to the apparatus for the formation of metal powders which are cooled at high rates.

Metal powders, or paticulate matter, have been previously formed in the prior art and representative patents disclosing various means and methods are set forth as follows: U.S. Pat. No. 1,351,865, U.S. Pat. No. 2,304,130 U.S. Pat. No. 2,310,590, U.S. Pat. No. 2,630,623, U.S. Pat. No. 2,956,304 U.S. Pat. No. 3,510,546, U.S. Pat. No. 3,646,177, U.S. Pat. No. 3,695,795 and U.S. Pat. No. 3,771,929.

SUMMARY OF THE INVENTION

According to the present invention, an apparatus is set forth which will produce a large quantity of metal powder which is cooled at a very high controlled rate.

It is an object of the invention to provide an efficient improved annular nozzle device for directing three curtains of cooling fluid at a desired mass flow for cooling metal particles.

It is a further object of this invention to provide an improved crucible tilting device which will correct for translation of the pouring spout about a pivot center and for horizontal displacement of the liquid metal stream due to its changing horizontal velocity component during the pour.

DESCRIPTION OF THE PREFERRED EMBODIMENT

Figure 1A:
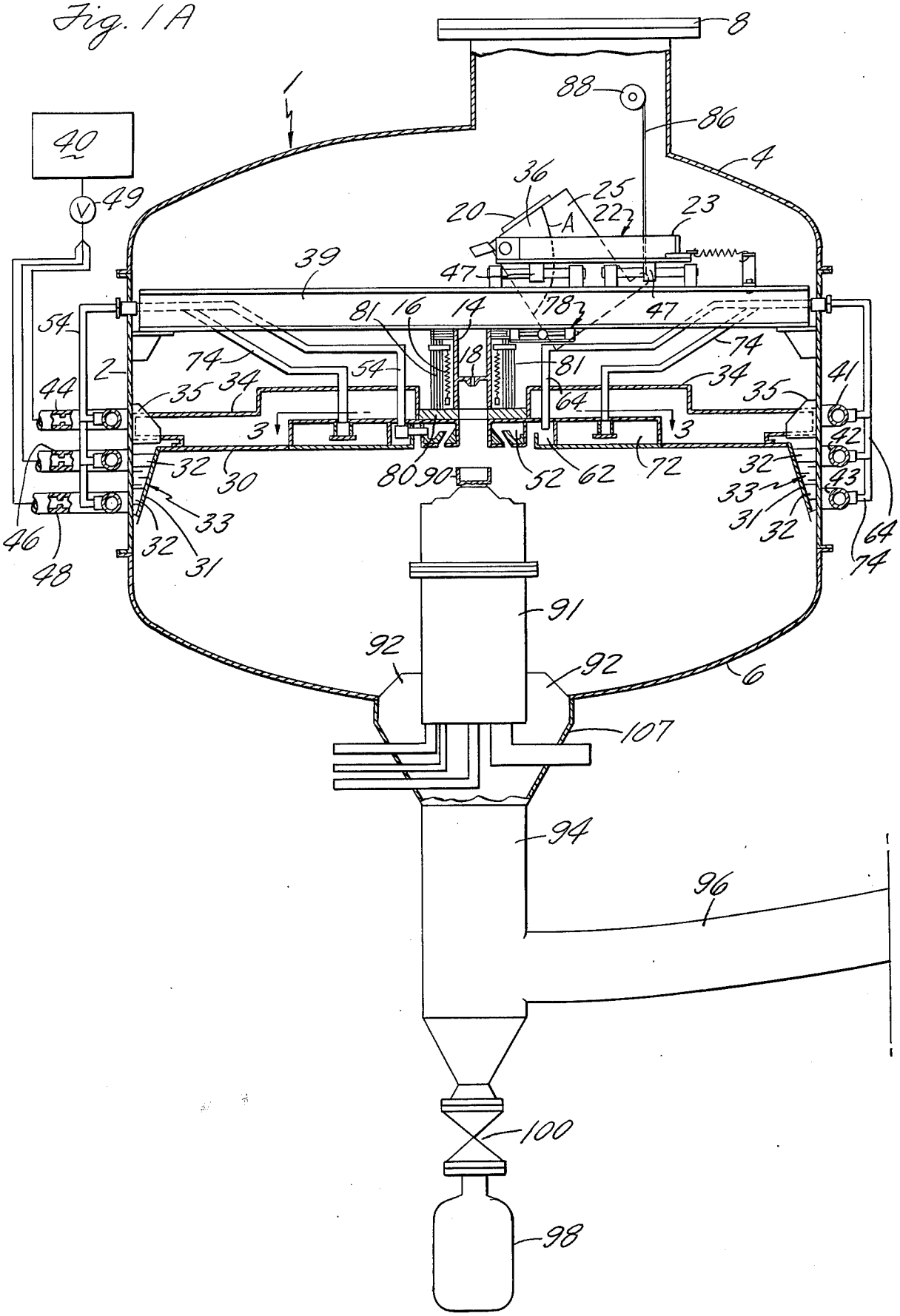
FIGS. 1A and 1B is a cross-sectional view of the apparatus for making metal powder.
Figure 1B:
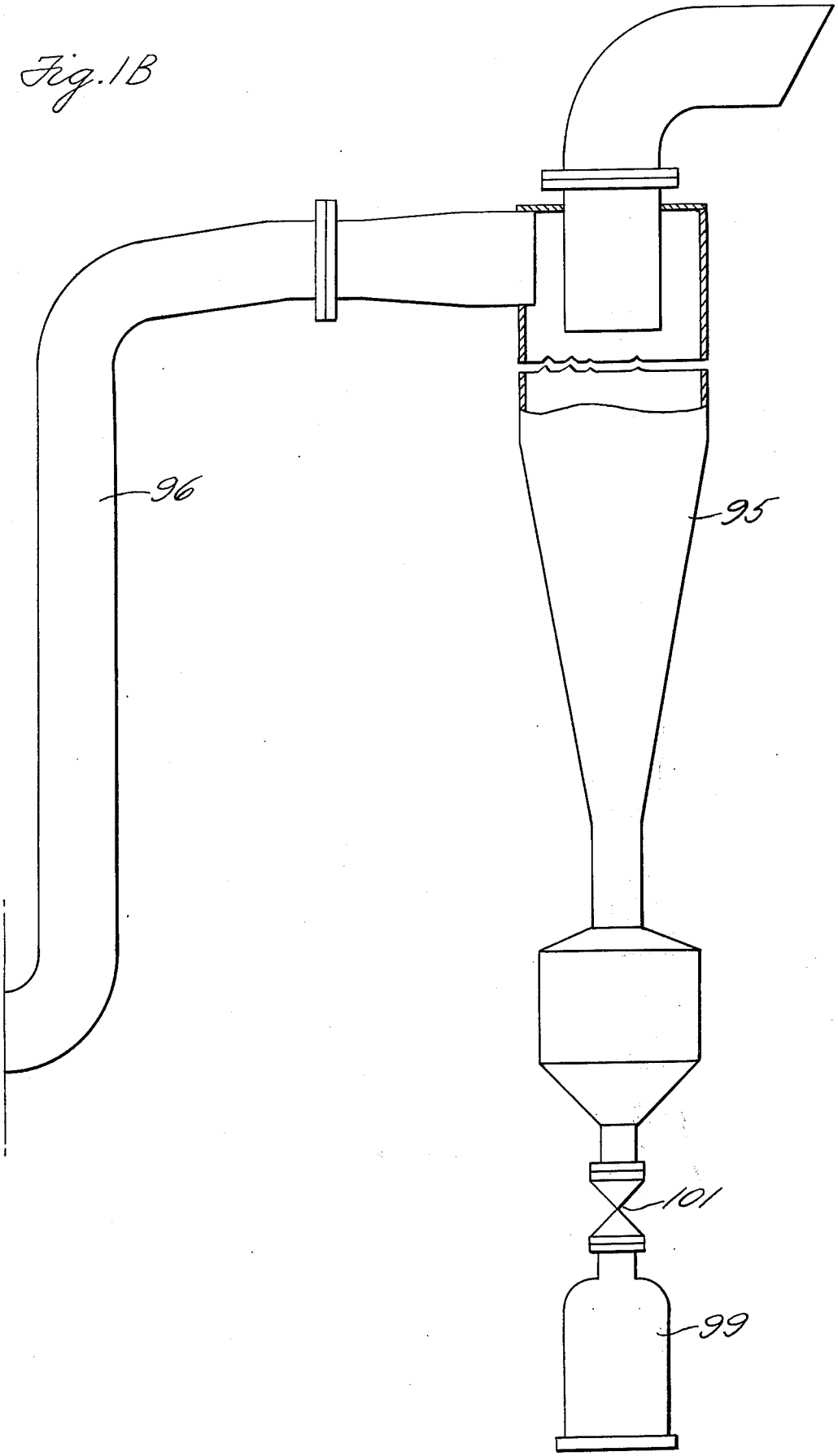

The apparatus shown in Figures 1A and 1B sets forth an apparatus for making metal powder. In Figure 1A a housing 1 capable of being placed under a vacuum, is shown having a center cylindrical section 2 with a top 4 and bottom 6. The top 4 has an access cover 8 connected thereto and the bottom 6 has a funnel shape section 10 connected thereto for a purpose to be hereinafter described. The interior of the housing 1 is separated into an upper and lower chamber by a nozzle plate means 10.

Figure 2:
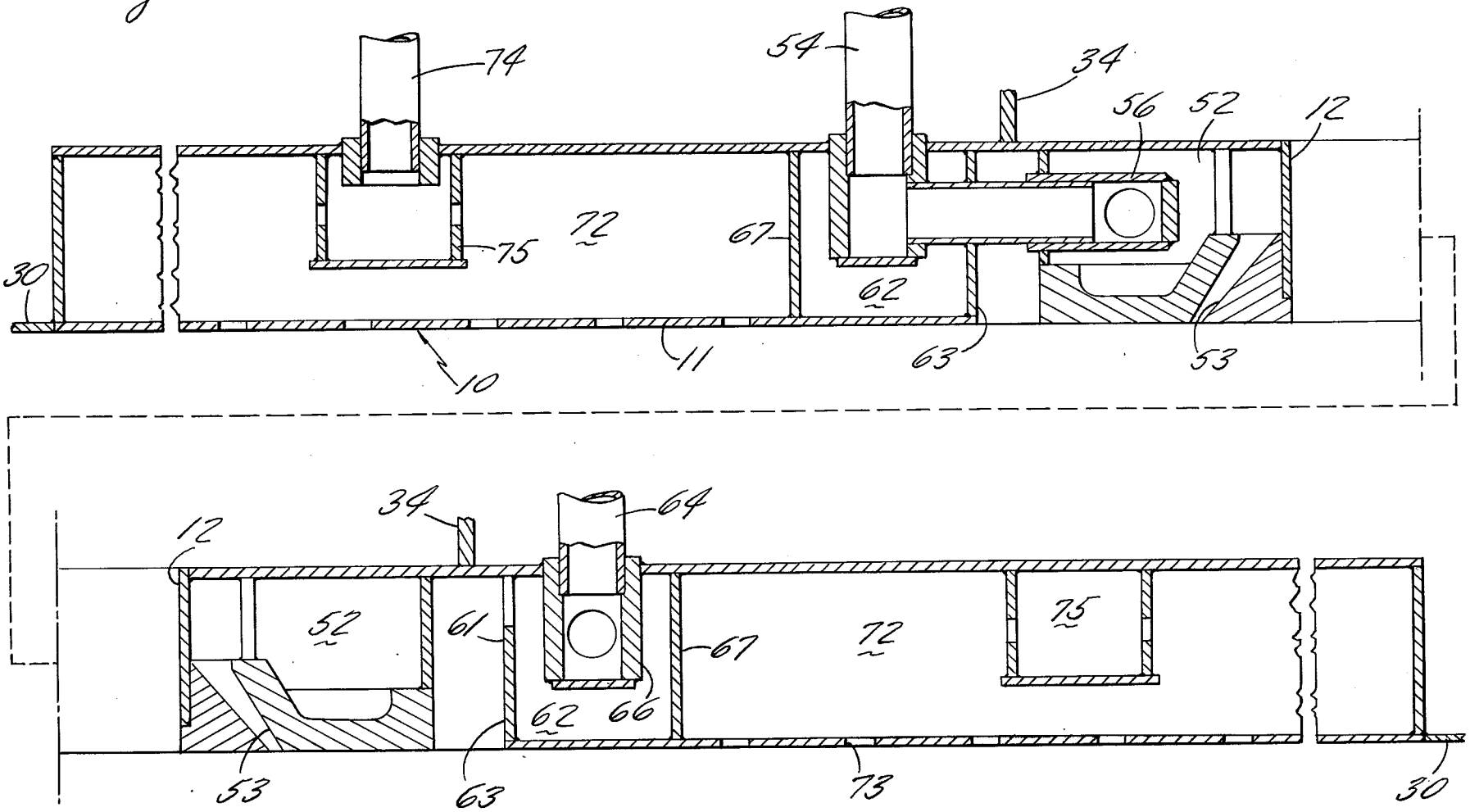
FIG. 2 is an enlarged view of the nozzle plate means.
Figure 3:
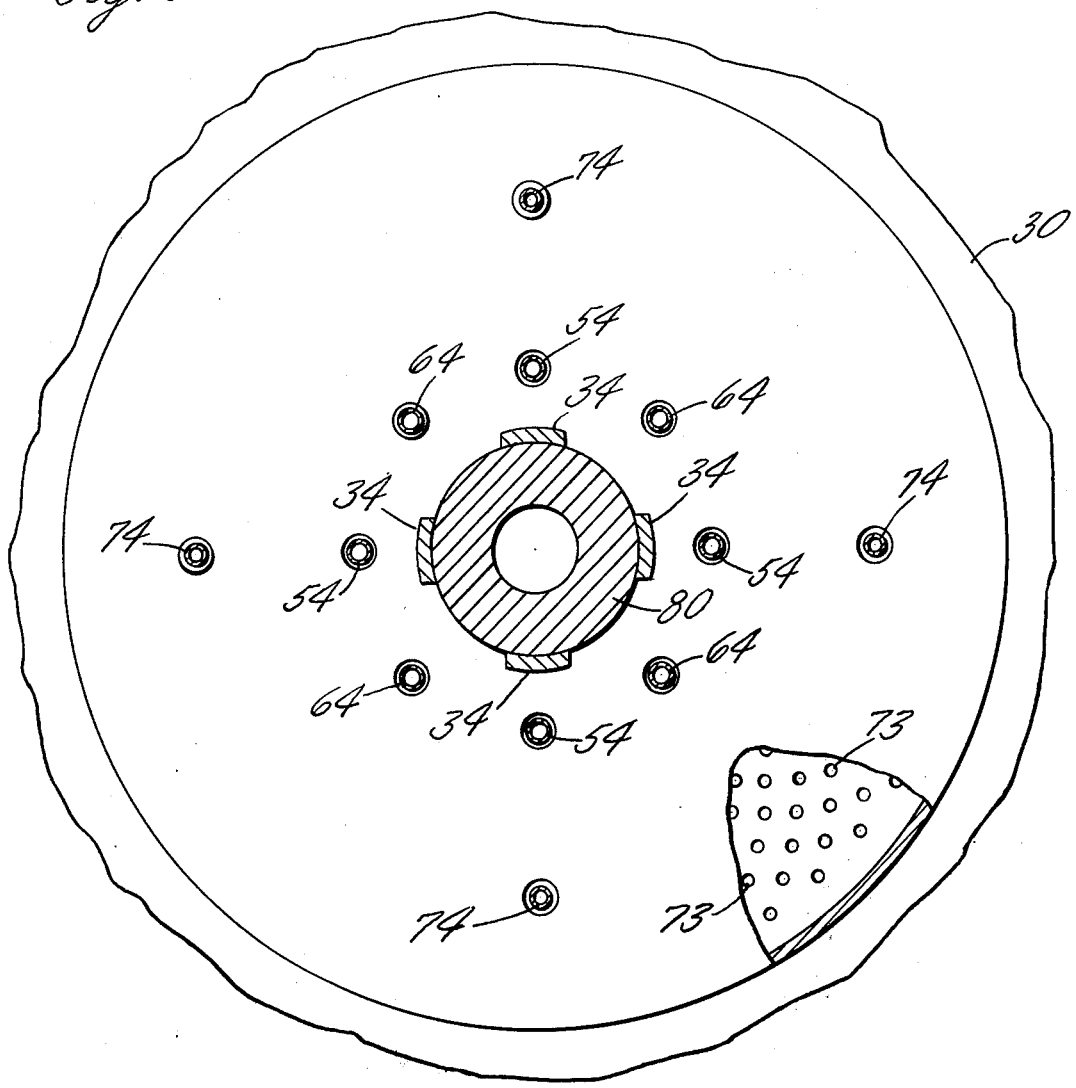
FIG. 3 is a view taken along the line 3—3 in FIG. 1A.
Figure 4:
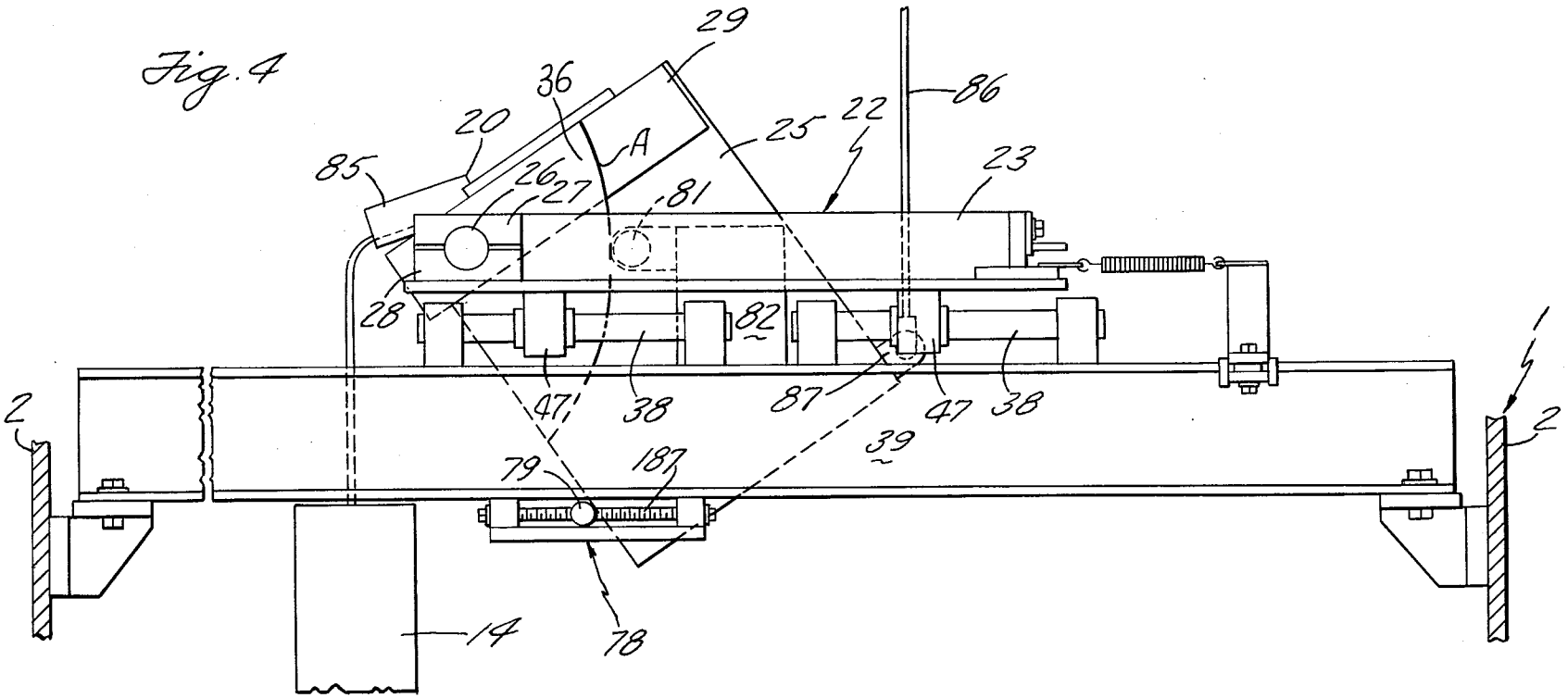
FIG. 4 is an enlarged view of the pour control device shown in FIG. 1A.

The nozzle plate means 10 is constructed having a center manifold section 11 comprising three annular manifolds 52, 62 and 72. Figure 2 shows the construction of the center section 11 of the nozzle plate means 10. The inner annular manifold 52 is formed around a central opening 12 in the nozzle plate means and has an annular nozzle means 53 formed therein. The intermediate annular manifold 62 is formed of an annular space having a baffle means 61 therearound to form substantially a constant flow exiting from the annular nozzle means 63. The third outer annular manifold 72 extends for a greater radial distance than the other two manifolds and has a plurality of openings 73 therein forming the nozzle means thereof. An inner annular distribution box 75 is fixed to the top of the annular manifold 72 to aid in equalizing the flow through all of the openings 73.

A coolant supply means 40 is connected to each of the annular manifolds 52, 62 and 72 of the nozzle plate means 10 by a coolant supply system wherein specific mass flows are directed to each of the annular manifolds. The coolant supply system comprises three exterior annular manifolds 41, 42 and 43 which are positioned around the housing 1. Each manifold 41, 42 and 43 is connected by conduits 44, 46 and 48, respectively, to a control valve 49 which is in turn connected to the coolant supply means 40. Each conduit 44, 46 and 48 has a fixed restriction therein proportioning the total mass flow in a predetermined manner between the three annular manifolds 41, 42 and 43.

Annular manifold 41 is connected to the inner annular manifold 52 by conduit 54. Conduit 54 extends into a junction box in annular manifold 62 which is in turn connected by a tubular section to a flow distribution box 56 which directs the flow from conduit 54 in two directions along the interior of the annular manifold 52. The tubular sections are supported by the top of the baffle 61 which is extended at these locations to the top of the annular manifold. Annular manifold 42 is connected to the inner annular manifold 62 by conduit 64. Conduit 64 extends into a flow distribution box 66 wherein the flow is directed along the interior of the annular space located between the baffle means 61 and its outer wall 67. Annular manifold 43 is connected to the outer annular manifold 72 by conduit 74 which is directed to the inner annular distribution box 75. The flow is directed from the box 75 into annular manifold 72 through a plurality of openings in an inner and outer radial direction.

The nozzle plate means 10 has an annular plate 30 having its inner edge welded to the outer edge of the bottom of the center section 11 of the nozzle plate means 10. The outer edge of the annular plate 30 is spaced from the side of the cylindrical section 2 of the housing 1 and has deflector shield means 31 extending downwardly therefrom which angles towards the inner wall of the cylindrical section 2. Stand-off tabs 32 are positioned around the outer surface of the shield means 31 and housing 1 to fixedly position the shield means in place. The lower end of the shield means 31 is spaced from the cylinder wall to provide a passage between the upper chamber and lower chamber. A seal means 33 is provided to prevent metal particles from passing from the lower chamber into the upper chamber.

Eight radial support members 34 are fixed to the top of the nozzle plate means 10 at eight locations spaced 45 ° apart to support the nozzle plate means 10. The inner ends of these support members 34 are welded to the top of the center manifold section 11 of the nozzle plate means 10 while the outer ends are fixed to the top of the annular plate 30 adjacent its outer edge. Each support member projects radially outwardly from the end of the annular plate 30 and is fixedly supported in brackets 35 fixed to the inner wall of the cylindrical section 2. The support members also support the conduits 54, 64 and 74.

The nozzle plate means 10 has an annular heat shield 80 positioned thereon between the inner ends of the support members 34. The inner opening of the annular heat shield is equal in size to the opening 12 of the nozzle plate means and is placed thereover. A tundish 14 is fixedly positioned on said annular shield member having a restricted opening 18 centrally located over the aligned openings in the heat shield 80 and nozzle plate means 10. The tundish 14 has a preheating furnace 16 therearound which can be of many types with the controls mounted externally of the housing 1. Heat shields 81 are also located around the heating furnace 16.

A crucible 20, having an induction furnace associated therewith is pivotally mounted in a moveable supporting carriage 22. The carriage 22 comprises 2 spaced side beams 23, connected at their rearward ends by a cross beam 24, and with a mounting frame 25, containing the crucible 20 and induction furnace associated therewith, pivotally mounted on trunnions 26 at forward ends. The free ends of the trunnion are mounted for rotation between trunnion blocks 27 and 28. The trunnions are fixed at their other end to the mounting frame 25 by a base plate 29. A cam plate 36 is fixed on each side of said mounting frame 25 around the trunnions 26 with spacer plates 37 being used to obtain the proper positioning of the cam plates 36.

An adjustable stop means 78 pre-sets the starting position of the mounting frame 25, prior to pouring the molten metal. A rod 79 is mounted between two adjusting screws 87 operationally mounted, one under each beam 39.

Bushings 47 are fixed to, and extend downwardly, from the front and rear of each of the side beams 23 which are positioned one each above a fixed supporting beam 39. Each beam 39 is connected at its ends to the inner wall of housing 1. Each bushing 47 is mounted for slidable movement on a rod 38 fixed at both ends to its cooperating fixed supporting beam 39. It can now be seen that the carriage 22 can be axially moved along the supporting beams 39.

Figure 5:
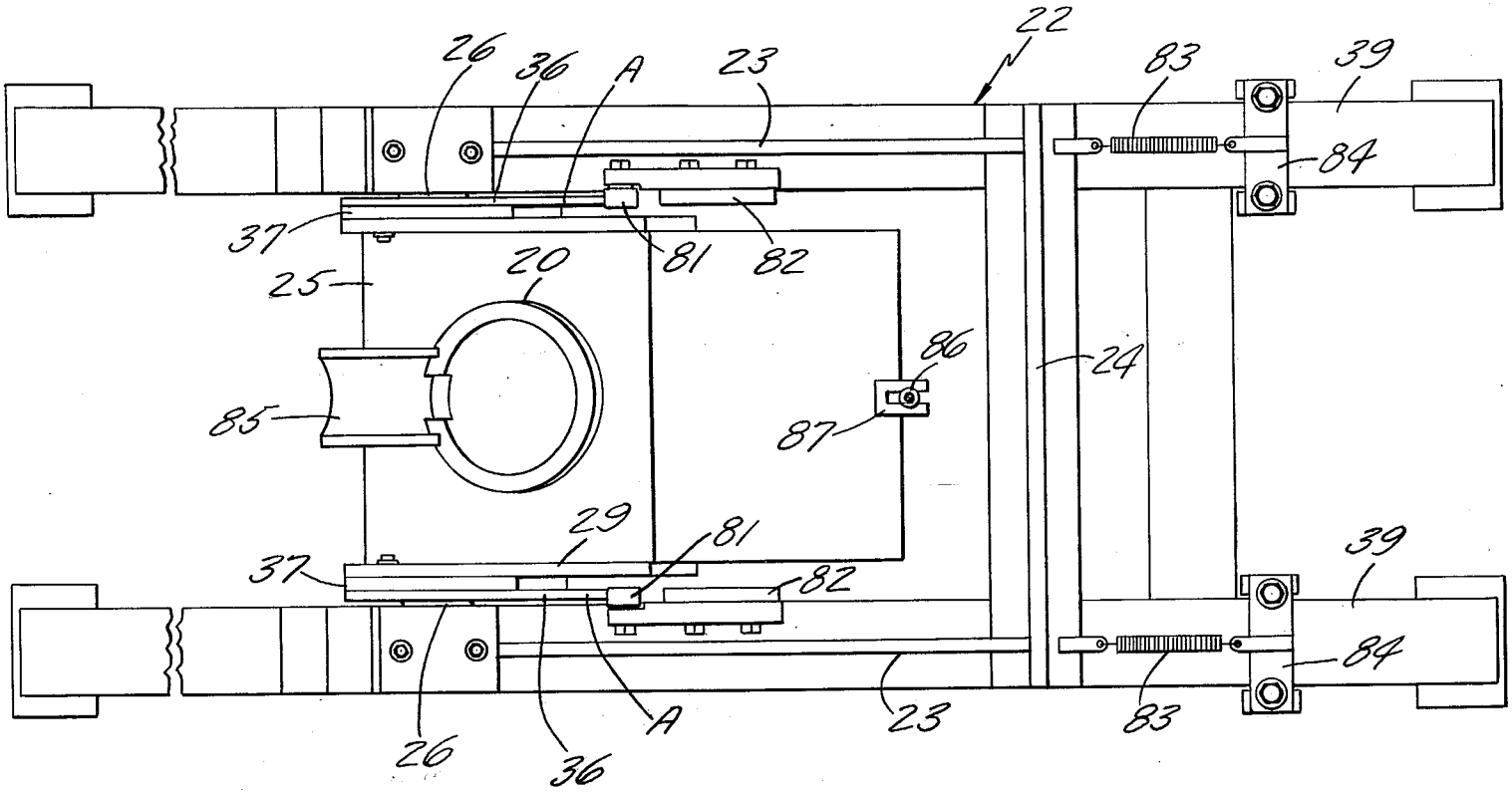
FIG. 5 is a top view of FIG. 4.

Cam rollers 81 are mounted for rotation, one each on an arm 82 on each side of the mounting frame 25. Each arm 82 is fixed to a supporting beam 39. A spring 83 is connected to each end of cross beam 24 and to a bracket 84 fixed to a supporting beam 39. It can be seen that the springs 83 bias the movable carriage 22 to the right (see Fig. 5) maintaining a cam surface A of each cam plate 36 against its associated roller 81. The cam surface A of the cam plate 36 is designed to correct for translation of the pouring spout 85 when the frame 25 is rotated about the center of the trunnions 26, and for changing horizontal displacement of the liquid metal stream due to its changing horizontal velocity component during the pour. The mounting frame 25 is rotated about the trunnions 56 by means of a cable 86 fixedly attached to a bracket 87 on the mounting frame 25 wherein the other end is connected to a winch 88.

A rotating disc, or atomizer rotor, 90 is postioned below the tundish 14 with the center of the disc being positioned under the nozzle 18. The device is rotated by any means desired and is mounted for rotation at the end of an upstanding pedestal 91 which is fixed to flat struts 92 in the funnel member 107. The tubes extending from the bottom of the pedestal provide for power in operating the rotating means and cooling fluid to cool the rotating disc, or atomizer rotor, 90. The funnel shape member 107 is connected to a central exhaust duct 94 which is in turn connected to a cyclone separator 95 by a conduit 96. The powder particles are collected in containers 98 and 99 which are attached to the system by on-off valves 100 and 101, respectively. In this apparatus the cyclone separator exhausts to atmosphere.

I claim:

1. An apparatus for producing metal powder from molten metal comprising a housing, container means in said housing for containing molten metal, means having an opening therein for receiving molten metal flow from said container means, means for tilting said container means for pouring molten metal therefrom into said opening, pivotal mounting means for pivotally mounting said container means, said pivotal mounting means being positioned on a movable carriage, means for controlling the movement of said carriage as the container means is pivoted by said tilting means to maintain a desired flow stream from said container means into the opening.

2. An apparatus as set forth in claim 1 wherein said means for controlling the movement of said carriage includes a cam device which provides a scheduled movement of said carriage as the container means is tilted.

3. An apparatus as set forth in claim 2 including cam follower means fixed to said housing, cam plate means fixed to said container means, said cam plate means having a camming surface means, means for biasing said camming surface means against said cam follower means.

4. An apparatus as set forth in claim 3 wherein said cam follower means comprises a cam roller mounted for rotation on each side of said container means, and said cam plate means comprises a cam plate fixed to each side of said container means having a camming surface in contact with its cooperating cam roller.

* * * * *

Disclaimer 4,025,249.—*Jerry A. King*, Palm Beach Gardens, Fla. APPARATUS FOR MAKING METAL POWDER. Patent dated May 24, 1977. Disclaimer filed Dec. 3, 1979, by the assignee, *United Technologies Corporation.*

Hereby enters this disclaimer to claims 1 and 2 of said patent.

[*Official Gazette, March 18, 1980.*]